US005106098A

United States Patent [19]

Filiczkowski

[11] Patent Number: 5,106,098

[45] Date of Patent: Apr. 21, 1992

[54] HORSE RACING GAME BOARD APPARATUS

[76] Inventor: Mark A. Filiczkowski, 266 S. Cedar Ave., Woodale, Ill. 60191

[21] Appl. No.: 615,134

[22] Filed: Nov. 19, 1990

[51] Int. Cl.[5] ..... A63F 3/00

[52] U.S. Cl. ..... 273/246

[58] Field of Search ..... 273/246, 248, 299, 148 A

[56] References Cited

U.S. PATENT DOCUMENTS

| | | | |
|---|---|---|---|
| 459,929 | 9/1891 | Fichtner | 273/246 |
| 895,128 | 8/1908 | Trant | 273/246 |
| 1,414,788 | 5/1922 | Parsons | 273/246 |
| 1,493,738 | 5/1924 | Cowan | 273/246 |
| 1,660,505 | 2/1928 | Hacker | 273/246 |
| 1,993,679 | 3/1935 | Mosse | 273/246 |
| 2,010,558 | 8/1935 | Neuzil | 273/246 |
| 2,036,630 | 4/1936 | Hastings | 273/246 |
| 3,057,623 | 10/1962 | Barnes | 273/246 |
| 3,416,802 | 12/1968 | Montes | 273/246 |
| 3,463,496 | 8/1969 | Weinstein et al. | 273/246 |
| 3,690,666 | 9/1972 | Seitz | 273/246 |
| 3,883,143 | 5/1975 | Kelley et al. | 273/246 |
| 3,951,412 | 4/1976 | Adams | 273/246 |
| 3,963,243 | 6/1976 | Contento | 273/246 |
| 4,033,587 | 7/1977 | Oliver | 273/246 |
| 4,042,245 | 8/1977 | Zarour | 273/246 |
| 4,057,254 | 11/1977 | Girres | 273/246 |
| 4,082,289 | 4/1978 | Merrit | 273/246 |
| 4,199,147 | 4/1980 | Stansberry | 273/246 |
| 4,244,579 | 1/1981 | Campos | 273/243 |
| 4,264,076 | 8/1981 | Duncan | 273/246 |
| 4,289,315 | 9/1981 | O'Barr | 273/148 A |
| 4,624,463 | 11/1986 | Glennon | 273/246 |
| 4,729,568 | 3/1988 | Welsh | 273/246 |
| 4,809,986 | 3/1989 | Pearce, Sr. | 273/246 |
| 4,874,177 | 10/1989 | Girardin | 273/246 |

FOREIGN PATENT DOCUMENTS

| | | | |
|---|---|---|---|
| 505365 | 5/1939 | United Kingdom | 273/246 |
| 626731 | 7/1949 | United Kingdom | 273/246 |

*Primary Examiner*—Benjamin Layno

*Attorney, Agent, or Firm*—Niro, Scavone, Haller & Niro

[57] ABSTRACT

A horse racing game apparatus is provided in which two or more people play on a game board by moving playing pieces around race-track shaped path. The path is two independent and concentric tracks that simulates dirt and turf track conditions, respectively. Players have a score card, to keep track of points, a racing horse card, to determine strengths and weaknesses of their horse during play, and a racing card, to determine the type of track to use in a given race as well as the potential prize money. Throughout the game, players pick cards to determine the course of play. Such cards include Weather Cards, Longshot Cards, Inquiry Cards and Photo Finish Cards. The object of the game is to score the most number of points and gain the most prize money. Due to the added parameters found in actual horse racing, the apparatus of the present invention can closely simulate horse race track action.

27 Claims, 8 Drawing Sheets

20

TODAY'S RACES
AT
LONGSHOT RACE TRACK

1. THE BREEDER'S CUP DIRT TRACK
1ST $50 2ND $30 3RD $20

2. C&G HANDICAP TURF TRACK
1ST $50 2ND $30 3RD $20

3. ILLINOIS STAKES DIRT TRACK
1ST $50 2ND $30 3RD $20

4. THE TRAINER'S CUP TURF TRACK
1ST $50 2ND $30 3RD $20

5. CALIFORNIA CLASSIC DIRT TRACK
1ST $50 2ND $30 3RD $20

Fig. 2B

20

TODAY'S RACES
AT
LONGSHOT RACE TRACK

6. THE DERBY TURF TRACK
1ST $50 2ND $30 3RD $20

7. THE JOCKEY'S CUP DIRT TRACK
1ST $50 2ND $30 3RD $20

8. C&G CLASSIC TURF TRACK
1ST $50 2ND $30 3RD $20

9. THE LONGSHOT STAKES DIRT TRACK
1ST $50 2ND $30 3RD $20

10. THE MILLION TURF TRACK
1ST $50 2ND $30 3RD $20

Fig. 2A

Fig. 11A
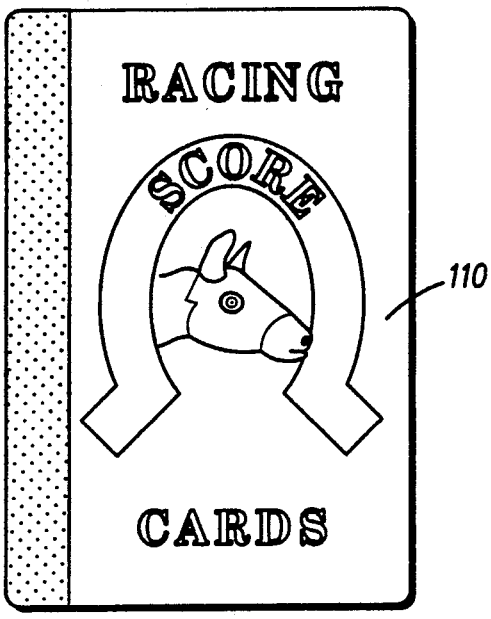
Fig. 11B
| RACING SCORE CARD | | | |
|---|---|---|---|
| RACE | HORSE | PLACE | PRIZE |
| 1 | | | |
| 2 | | | |
| 3 | | | |
| 4 | | | |
| 5 | | | |
| 6 | | | |
| 7 | | | |
| 8 | | | |
| 9 | | | |
| 10 | | | |
| TOTAL | | | |
112
114
112
USE ONLY IN CASE OF TIE.
THE FEATURED 11th RACE
WIN ☐
PLACE ☐
SHOW ☐
Fig. 11C
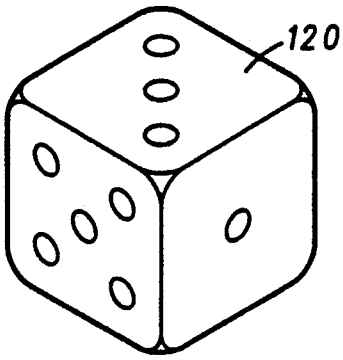
Fig. 12

HORSE RACING GAME BOARD APPARATUS

BACKGROUND OF THE INVENTION

The present invention relates generally to games, but more particularly to horse racing games It is an improved race game with playing pieces representing horses that are moved over a playing board designed to represent dirt and turf race tracks.

The present invention is an improvement over previous race horse games because it more closely simulates an actual horse race by taking into account such factors as weather, the horses' training and capabilities relative to given track and weather conditions, events such as bumping and interference, and the excitement of photo finishes.

SUMMARY OF THE INVENTION

The present invention includes two independent tracks, generally oval in shape. Both tracks are divided into a number of spaces, with each space containing an artistic representation of an aspect of the subject of horse racing. Playing pieces are moved along the tracks as determined by the throw of a die and, when appropriate, the drawing of a playing card.

The artistic representations depict events that do, or could, occur during an actual horse race, and provide directions for additional actions to be taken by the player whose playing piece lands on those spaces. The additional actions include moving the playing piece or drawing a playing card.

The invention provides playing pieces in the shape of racing horses and various types of playing cards to be drawn in accordance with instructions in the spaces of each track.

The playing cards simulate the conditions at an actual race. They provide information comprising a horse's capabilities, the weather, the outcome of such events as bumping and interference, and final standing after a photo finish.

Racing Cards are provided to determine which track is used for each race as well as how many points are awarded for winning, placing or showing in each race. Racing Score Cards are provided to allow each player to tally his/her points according to how that player's horse finished for each race. Racing Horse Cards represent the horses and their training and capabilities. The object of the game, provided by the present invention, is for a participating player to finish first, second, or third in as many of ten races as possible, and have the most points at the end of the tenth race.

An object of the invention is to provide a novel and improved horse racing game apparatus which simulates the conditions and events occurring at a real horse race.

Another object of the invention is to provide a novel and improved race game apparatus which provides players of the game of the invention with varying play each time the game is played by use of a random combination of the random actions of tossing a die and drawing playing cards.

Playing pieces are moved around one of the tracks according to the toss of a die, and where appropriate, by the draw of a playing card. The choice of track is predetermined by a racing card. Each space provides for an event to occur that does, or may, affect the player that lands there. Some of the spaces provide for the player to choose a particular type of playing card, some provide for moving ahead, and some provide for moving back.

BRIEF DESCRIPTION OF THE DRAWINGS

FIGS. 2A and 2B show two exemplary Racing cards of the present invention, respectively, that list the races of the day.

FIG. 11A shows the outer cover of the Racing Score Cards Booklet.

FIG. 11B illustrates an exemplary Racing Score Card of the present invention.

FIG. 11C illustrates the reverse side of a Racing Score Card.

FIG. 12 is a perspective view of a six-sided die.

DETAILED DESCRIPTION OF THE PREFERRED EMBODIMENT

Game Apparatus

Figure 1A:
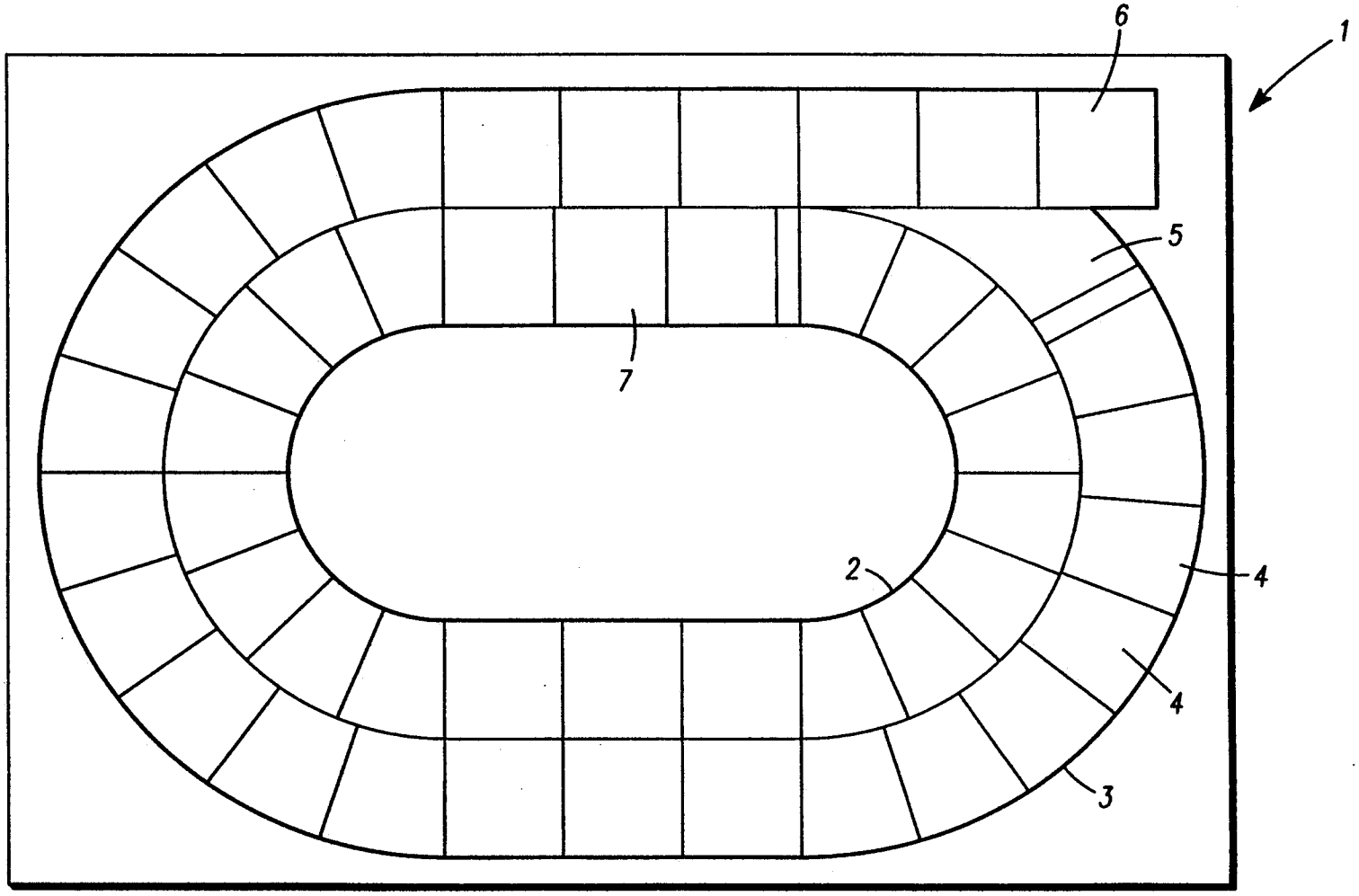
FIG. 1A is a plan view of the game board of the present invention showing two concentric, generally oval, tracks on which playing pieces move.

Referring to FIG. 1A, there is shown a game board 1 on which the horse racing game is played. The game board includes an inner turf track 2 and outer dirt track 3. The two tracks are substantially concentric. The arrangement of the tracks 2 and 3 simulate the shape of a typical racetrack. An extended portion 6 is provided for starting posts in a race using the outer dirt track 3. Winner's Circle 5 is a space designated to be the end of a race to be run on the outer dirt track 3. Winner's Circle 7 is a space designated to be the end of a race run on the inner track 2.

Figure 1B:
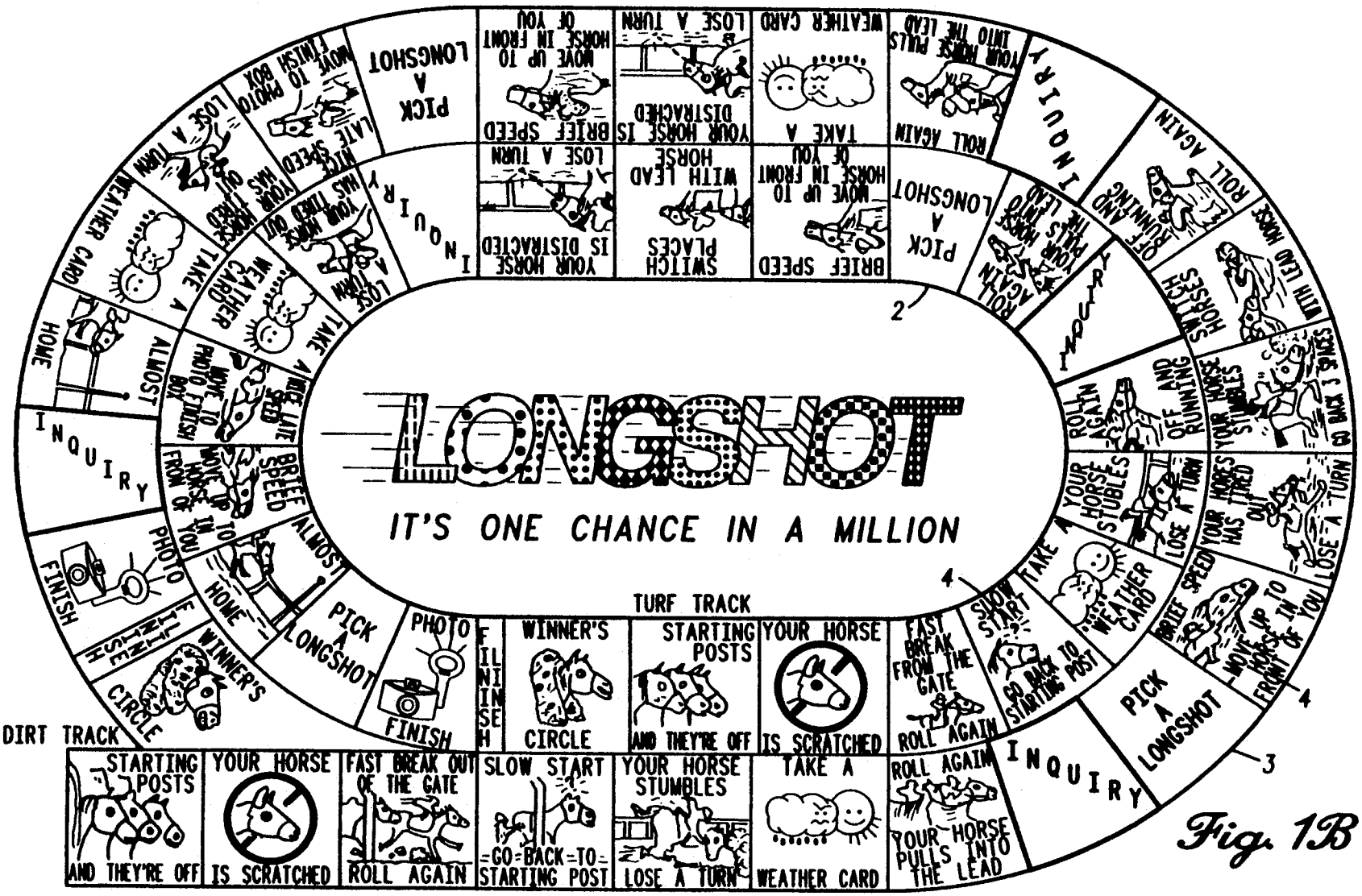
FIG. 1B is a plan view of the game board of the present invention with illustrated spaces.

Both the inner turf track 2 and the outer dirt track 3 are divided into a number of spaces 4. As shown in FIG. 1B, a group of spaces 4 depict an artistic representation of either a Weather Card, Pick A Longshot Card, Inquiry Card or Photo Finish Cards. Another Group of spaces 4 depict illustrations of instructions to be followed during the course of the game. Such instructions are, for example, Starting Posts, Your Horse is Scratched, Fast Break Out of the Gate—Roll Again, Slow Start—Go Back to Starting Post, Almost Home, Winner's Circle, Roll Again—Your Horse Pulls Into the Lead, Brief Speed—Move Up to the Horse in Front of You, Your Horse Stumbles—Lose a Turn, Your Horse Has Tired Out—Lose a Turn, Switch Horses With Lead Horse, Your Horse Stumbles—Go Back 3 Spaces, Off and Running—Roll Again, and Your Horse is Distracted.

A space marked "Starting Posts" represents the starting point of a race and a space marked "Winner's Circle" represents the ending point or finish of a race. Other spaces are randomly illustrated with the remaining instructions. Each space depicts an illustration of an instruction of the present invention.

Referring to FIGS. 2A and 2B, a set of racing cards 20 are provided. Each card carries indicia specifying the possible races of the day, including the potential prize money and whether the race will be run on turf or on dirt.

Figure 3:
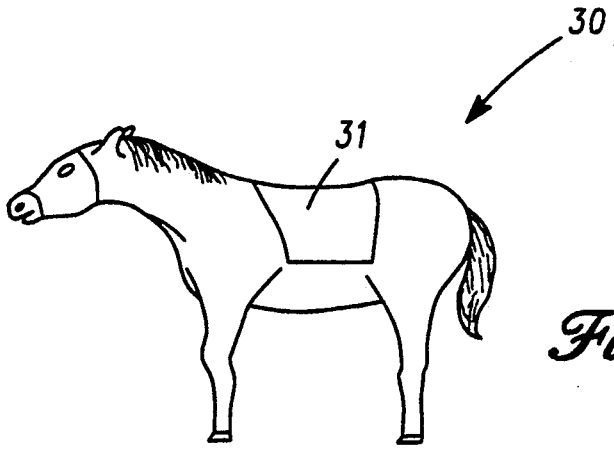
FIG. 3 is a side view of a playing piece of the present invention.

A playing piece 30 is shown in FIG. 3 to be a miniature three dimensional embodiment of a horse. The playing piece 30 is an example of the number of playing pieces provided by the invention. Each playing piece 30 has a different color saddle 31 to differentiate them from one another. The size of each playing piece 30 is such to fit completely within one of the spaces 4.

Figure 4A:
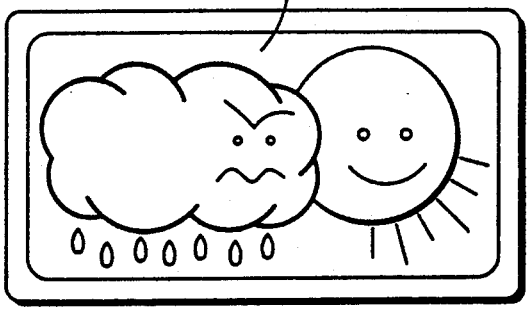
FIG. 4A shows the illustration present on the Weather Cards.
Figure 4B:
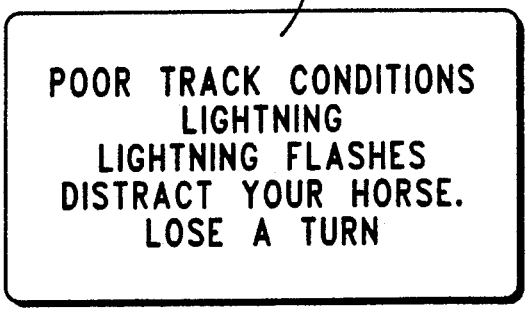
FIG. 4B shows an exemplary instruction present on the reverse side of the Weather Cards.

FIGS. 4A and 4B show one of the Weather Cards. Each card 40 carries indicia designating specific instructions regarding movement of a playing piece 30 on the game board 1 relating to changes in the weather and the resultant effect on a horse. An example of a Weather Card instruction is shown in FIG. 4B. The reverse side, as shown in FIG. 4A, carries an illustrative indication that it is a Weather Card.

Figure 5A:
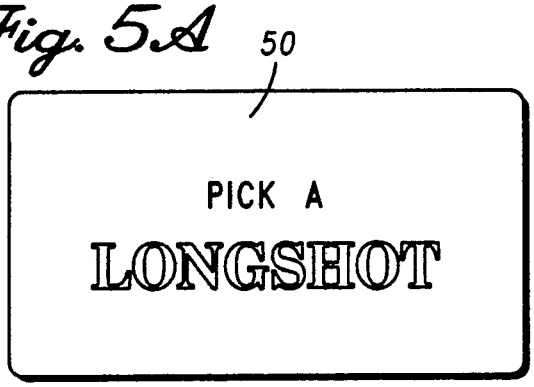
FIG. 5A shows the illustration present on the Pick a Longshot Cards.
Figure 5B:
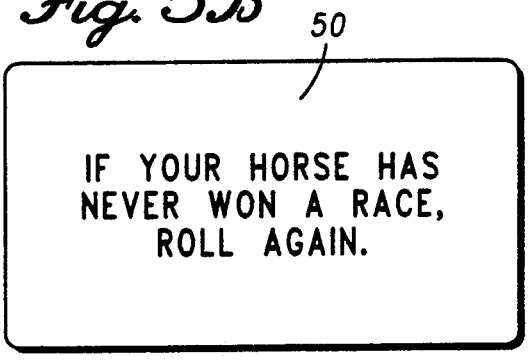
FIG. 5B shows an exemplary instruction present on the reverse side of the Pick a Longshot Cards.

FIGS. 5A and 5B show one of the Pick A Longshot Cards. Each card 50 carries indicia designating specific instructions regarding movement of a playing piece 30 on the game board 1 relating to picking a longshot to win the race. An example of a Pick a Longshot Card instruction is shown in FIG. 5B. The reverse side, as shown in FIG. 5A, carries an illustrative indication that it is a Pick a Longshot Card.

Figure 6A:
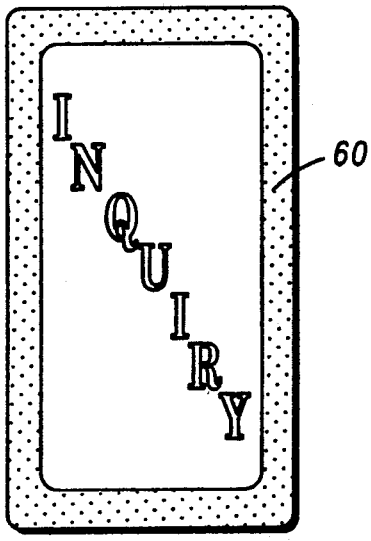
FIG. 6A shows the illustration present on the Inquiry Cards.
Figure 6B:
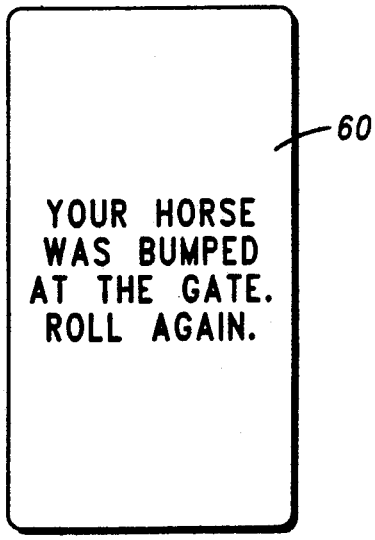
FIG. 6B shows an exemplary instruction present on the reverse side of the Inquiry Cards.

FIGS. 6A and 6B show one of the Inquiry Cards. Each card 60 carries indicia designating specific instructions regarding movement of a playing piece 30 on the game board 1 relating to unknown and unforeseen changes in the race. An example of an Inquiry Card instruction is shown in FIG. 6B. The reverse side, as shown in FIG. 6A, carries an illustrative indication that it is an Inquiry Card.

Figure 7A:
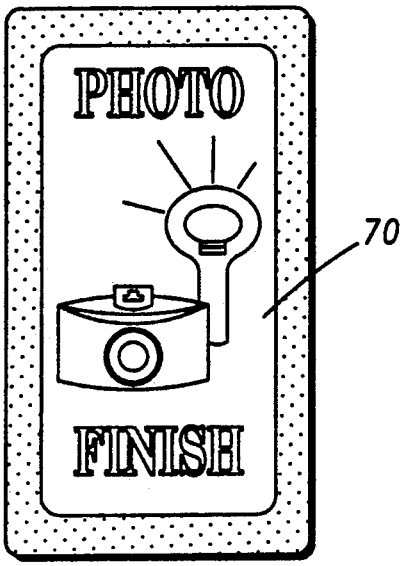
FIG. 7A shows the illustration present on the Photo Finish Cards.
Figure 7B:
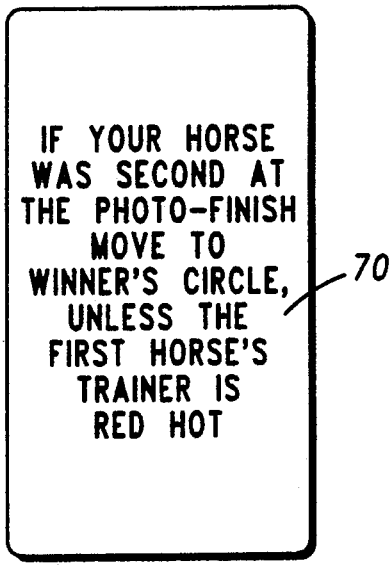
FIG. 7B shows an exemplary instruction present on the reverse side of the Photo Finish Cards.

FIGS. 7A and 7B show one of the Photo Finish Cards. Each card 70 carries indicia designating specific instructions regarding movement of a playing piece 30 on the game board 1 relating the determination of a photo finish at the end of a race. An example of a Photo Finish Card instruction is shown in FIG. 7B. The reverse side, as shown in FIG. 7A, carries an illustrative indication that it is a Photo Finish Card.

Figure 8A:
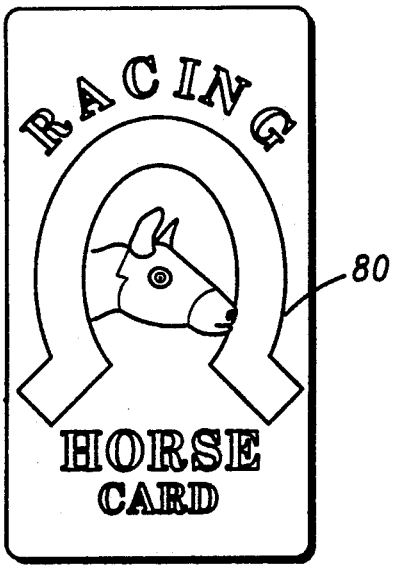
FIG. 8A shows the illustration present on the Racing Horse Cards.
Figure 8B:
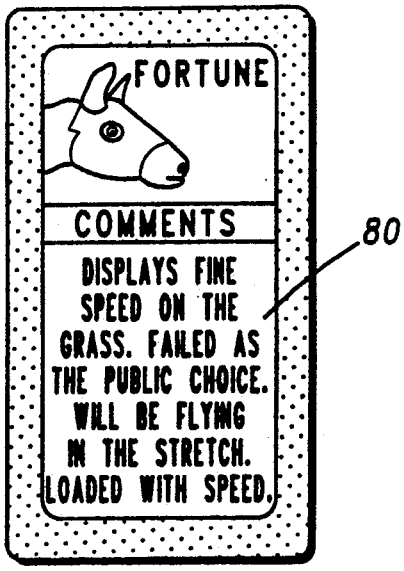
FIG. 8B shows an exemplary instruction present on the reverse side of the Racing Horse Cards.

FIGS. 8A and 8B show one of the Racing Horse Cards. Each card 80 carries indicia designating specific instructions regarding movement of a playing piece 30 on the game board 1 relating the specific abilities, weaknesses and strengths of a horse. An example of a Racing Horse Card instruction is shown in FIG. 8B. The reverse side, as shown in FIG. 8A, carries an illustrative indication that it is a Racing Horse Card.

The indicia on the horse cards relating to specific abilities of the horses, such as speed, weakness, and whether he has a hot trainer, are required to be used in conjunction with the weather, photo finish and longshot cards to complete the execution of the instruction to the player. Indicia on the weather, photo finish and longshot cards require the player to look to his horse card for those specific abilities to complete the instruction. Listed below are many examples of the instructional indicia on weather, photo finish and longshot cards;

Weather Cards

GOOD TRACK CONDITIONS, DRY WEATHER, IF YOUR HORSE RUNS WELL ON TURF OR DIRT TRACK, ROLL AGAIN. IF YOUR HORSE RUNS WELL ON WET TRACK, LOSE A TURN

GOOD TRACK CONDITIONS, SUNNY SKIES. IF YOUR HORSE HAS SPEED ON WET TURF OR MUDDY TRACK, LOSE A TURN. IF NOT, ROLL AGAIN

POOR TRACK CONDITIONS DOWNPOUR, IF YOUR HORSE RUNS WELL ON WET TURF OR MUDDY TRACK, ROLL AGAIN. IF NOT, LOSE A TURN.

POOR TRACK CONDITIONS, RAIN, IF YOUR HORSE RUNS WELL ON WET TURF OR MUDDY TRACK, ROLL AGAIN. IF NOT, LOSE A TURN.

GOOD TRACK CONDITIONS, DRY WEATHER, IF YOUR HORSE RUNS WELL ON TURF OR DIRT TRACK, ROLL AGAIN. IF YOUR HORSE RUNS WELL ON WET TRACKS, LOSE A TURN.

POOR TRACK CONDITIONS, LIGHTNING, LIGHTNING FLASHES, DISTRACT YOUR HORSE. LOSE A TURN.

FAIR TRACK CONDITIONS, LIGHT DRIZZLE. YOUR HORSE IS NOT EFFECTED UNLESS YOUR HORSE RUNS WELL ON WET TRACKS, THEN ROLL AGAIN.

POOR TRACK CONDITIONS, RAIN STORM. IF YOUR HORSE HAS SPEED ON WET TURF AND MUDDY TRACK, ROLL AGAIN. IF NOT, LOSE A TURN.

POOR TRACK CONDITIONS, SUMMER SHOWERS. IF YOUR HORSE RUNS WELL ON WET TURF OR MUDDY TRACK, ROLL AGAIN. IF NOT, LOSE A TURN.

GOOD TRACK CONDITIONS, CLEAR SKIES. IF YOUR HORSE RUNS WELL ON DIRT OR TURF TRACK, ROLL AGAIN. IF YOUR HORSE RUNS WELL ON WET TURF OR MUD, THEN LOSE A TURN.

Photo Finish Cards

IF YOUR HORSE WAS SECOND AT THE PHOTO FINISH MOVE TO WINNER'S CIRCLE UNLESS YOUR HORSE DOES NOT HAVE MUCH SPEED THEN FINISH LAST.

IF YOUR HORSE WAS FIRST AT THE PHOTO FINISH MOVE TO WINNER'S CIRCLE, UNLESS YOUR HORSE HAS MOVED UP IN CLASS THEN MOVE BACK THREE SPACES.

IF YOUR HORSE WAS FIRST AT THE PHOTO FINISH MOVE TO WINNER'S CIRCLE, UNLESS THE SECOND HORSE CLOSES WELL OR IS FAST FROM THE GATE.

IF YOUR HORSE WAS FIRST AT THE PHOTO FINISH MOVE TO WINNER'S CIRCLE, UNLESS YOUR HORSE IS A FIRST STARTER

THEN MOVE BACK THREE SPACES AND LAST HORSE MOVES UP.

IF YOUR HORSE WAS SECOND AT THE PHOTO FINISH MOVE TO WINNER'S CIRCLE, UNLESS THE FIRST HORSE HAS SPEED IN THE STRETCH.

IF YOUR HORSE WAS FIRST AT THE PHOTO FINISH MOVE TO WINNER'S CIRCLE, UNLESS THE LAST HORSE FINISHES STRONG BETWEEN HORSES OR IS FAST IN THE STRETCH.

IF YOUR HORSE WAS SECOND AT THE PHOTO FINISH MOVE TO WINNER'S CIRCLE, UNLESS YOUR HORSE HAS NEVER WON A RACE THEN THE FIRST HORSE MOVES AHEAD.

IF YOUR HORSE WAS LAST AT THE PHOTO FINISH MOVE TO WINNER'S CIRCLE, UNLESS THE FIRST HORSE DROPPED INTO AN EASIER SPOT.

IF YOUR HORSE WAS FIRST AT THE PHOTO FINISH MOVE TO WINNER'S CIRCLE, UNLESS THE SECOND HORSE WAS SPEED OR EXPERIENCE ON TURF.

IF YOUR HORSE WAS SECOND AT THE PHOTO FINISH MOVE TO WINNER'S CIRCLE, UNLESS THE FIRST HORSE'S TRAINER IS RED HOT.

Longshot Cards

IF YOUR HORSE FINISHES STRONG BETWEEN HORSES, ROLL AGAIN.

IF YOUR HORSE MOVES UP IN CLASS, LOSE A TURN.

IF YOUR HORSE DROPS INTO AN EASIER SPOT ROLL AGAIN, UNLESS YOUR HORSE DOESN'T HAVE MUCH SPEED THEN LOSE A TURN.

IF YOUR HORSE IS WELL TRAINED AND HAS A HOT TRAINER, ROLL AGAIN.

IF YOUR HORSE HAS POOR SPEED ON THE TURF, LOSE A TURN.

IF YOUR HORSE IS FAST IN THE STRETCH, ROLL AGAIN.

IF YOUR HORSE IS LOADED WITH SPEED OR FULL OF RUN, ROLL AGAIN.

IF YOUR HORSE IS FAST FROM THE GATE, ROLL AGAIN.

IF YOUR HORSE HAS NEVER WON A RACE, ROLL AGAIN.

IF YOUR HORSE IS AN INITIAL STARTER, LOSE A TURN, UNLESS YOUR HORSE IS FAST IN THE STRETCH THEN ROLL AGAIN.

Each of the weather, photo finish and longshot cards have instructional clauses that require a determination of what a particular horse ability is to complete the instruction. Listed below are many examples of the "comments" sections on the horse cards which include the horse's abilities that will be needed to complete the weather, photo finish and longshot instructions:

Horse Cards

NICE SPEED AND RACES WELL ON THE GRASS. POOR RUNNER ON THE DIRT BUT EXCELLENT SPEED ON MUDDY TRACK. TRAINER IS RED HOT.

HAS NEVER RACED WELL ON THE TURF. WILL SHOW NICE SPEED OUT OF THE GATE. CLOSED WELL IN LAST RACE ON THE DIRT. FULL OF RUN.

THIS FINALLY HAS NEVER WON A RACE. BLED IN LAST RACE. POOR SPEED ON BOTH DIRT AND TURF. RAIN SEEMS TO HELP HER CHANCES.

FINISHED STRONG BETWEEN HORSES IN LAST RACE. MADE NICE MOVE IN MID-STRETCH. HAS RACED WELL ON THE LAWN. LATE SPEED THEREAT HERE.

TRAINING WELL AND MAKES INITIAL START OF THE YEAR HERE. FULL OF RUN. WILL BE CHARGING IN THE STRETCH. WILL CLOSE WELL TODAY.

LOADED WITH SPEED FROM THE GATE. CHASED FAST HORSES IN LAST RACE. WELL TRAINED AND TRAINER IS HOT. PREFERS THE DIRT TRACK POOR SPEED ON TURF.

DISPLAYS FINE SPEED ON THE GRASS. FAILED AS THE PUBLIC CHOICE. WILL BE FLYING IN THE LAST STRETCH. LOADED WITH SPEED.

MOVES UP IN CLASS. EXCELLENT SPEED FROM THE GATE. TURF EXPERIENCE. RACED POORLY ON THE DIRT. SPEED BETWEEN HORSES.

DROPS INTO MUCH EASIER SPOT. TIRED ON THE TURN IN THE LAST RACE. RUNS WELL ON WET TURF AND MUDDY TRACK. NOT MUCH SPEED.

DROPS INTO EASIER SPOT AND WILL CLOSE WELL TODAY. THIS COLT HAS SPEED. RACES WELL ON BOTH DIRT AND TURF.

THIS WELL BRED FIRST STARTER HAS SHOWN SPEED IN WORK OVER THE TURF. IMPROVES ON THE DIRT TRACK. SPEED WORKS FOR THIS FIRST TIME STARTER.

EXCELLENT SPEED FROM THE GATE AND THIS FILLY WILL SET THE PACE TODAY. WILL BE CHARGING FASTEST OF ALL IN THE STRETCH. LIKES THE TURF.

The abilities of a player's horse, as set forth on his or her horse card, will affect all of the outcomes of the weather, photo finish and longshot cards. The instructions on those cards and their outcomes will be dependent on the specific horse abilities of the horse of the player who selects the card. If another player were to pick the same card, the instruction and the resultant outcome would be different due to different horse abilities of that player's horse.

Figure 10:
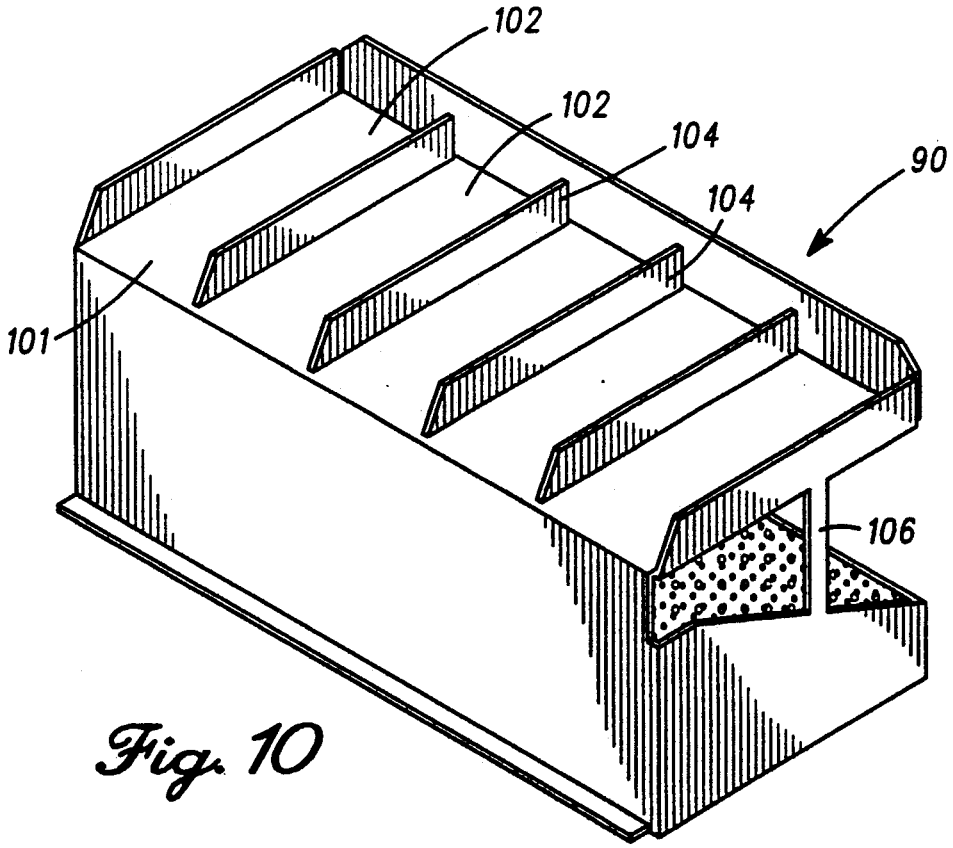
FIG. 10 is a perspective view of the racing stadium.
Figure 9:
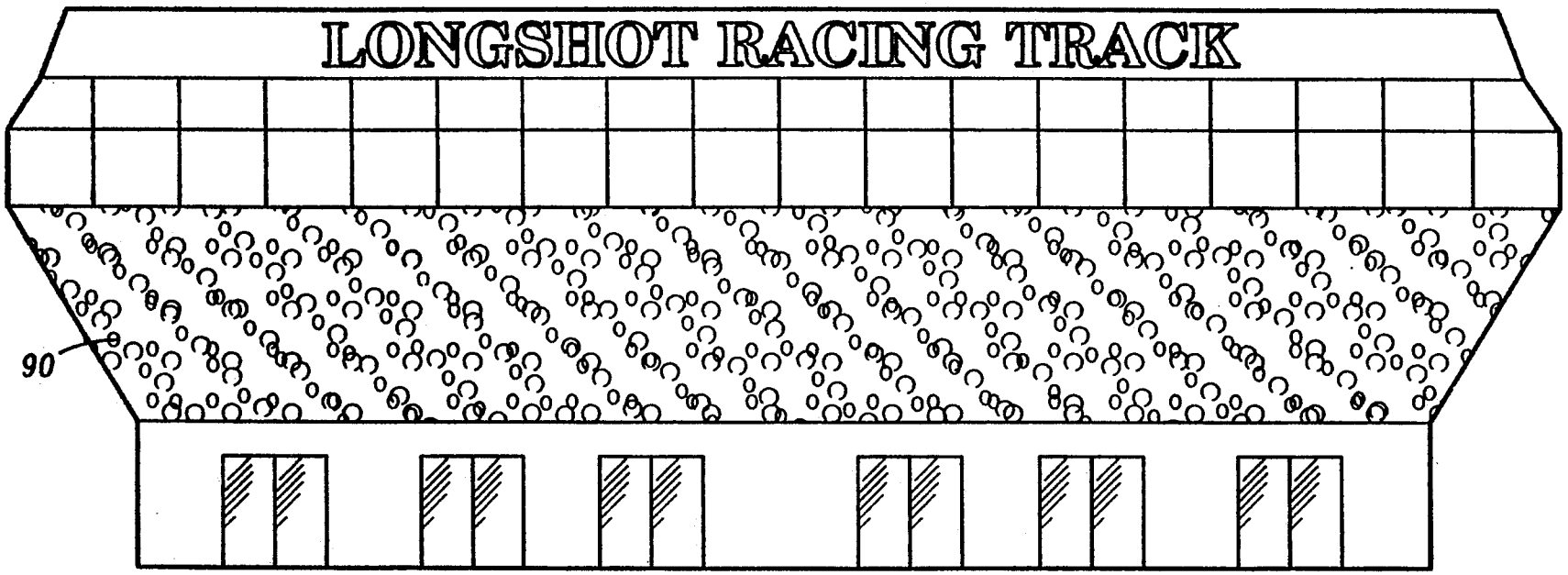
FIG. 9 is a front view of the racing stadium of the present invention.

In FIGS. 9 and 10, a Longshot Racing Track stadium 90 is shown. The racing stadium 90 is a miniature of an actual racing stadium including realistic features illustrated thereon. Included in the illustration on the racing stadium 90 is a crowd of people watching the race as well as a roof over the crowd bearing the name of the game according to the present invention. The racing stadium 90 is situated on the game board 1 adjacent and parallel to a straight portion of the oval tracks 2 and 3. Such a stadium 90 adds realism to the game of the invention.

As shown in FIG. 10, the stadium 90 also has spaces 102 where the Weather, Pick a Longshot, Inquiry, Photo Finish and Racing Horse Cards may be stored during play. A card deck holder 101 is formed by spaces 102 and partitions 104 located on the top portion of the stadium 90. A strut 106 is provided on both sides of the stadium 90 to maintain adequate support for the decks of cards.

FIGS. 11A, 11B and 11C show the complete Racing Score Card Booklet 110. The cover of the Booklet, as shown in FIG. 11A, has an illustration showing that it contains Racing Score Cards 112. The Racing Score Card Booklet 110 contains a booklet of Racing Score Cards 112, as shown in FIG. 11B, which may be torn out when needed during play. Each card carries indicia in the form of a grid 114, arranged for entry of a horse's name, its finishing place and prize received into a space in the grid 112 according to which race was run. On the back of each Racing Score Card 112, as shown in FIG. 11C, is a scoring provision that is to be used only in the case of a tie at the end of ten races.

As shown in FIG. 12, a six-sided die 120 is employed during game play, and each side of the die carries a unique one of the numbers 1–6. The die is in the form of a cube. The die, after rolling, will come to rest on one of the six square sides, the actual value of the throw being the number on the side facing up.

Rules of Play

To begin the game, a Racing card 20 is chosen, after which each player chooses a playing piece 30 and takes a Racing Horse Card 80 and Racing Score Card 112. The Racing Horse Card 80 may be exchanged for another at the end of any race, or may be retained for all ten races. However, a player may only have one Racing Horse Card 80 at a time.

Each player then rolls the die 120 once. The order of play is determined by the number on the die 120. The player with the highest roll begins play by again throwing the die 120 and moving his/her playing piece 30 the number of spaces 4 indicated by the die, and performs any action required by virtue of landing on that space. That action may be to move his/her playing piece 30 forward or backward, lose a turn, roll again, or pick from one of the four decks of playing cards. After a player has completed his/her turn, the next player rolls the die 120, moves his/her playing piece 30 as indicated by the die, and so on. A player's playing piece 30 remains on the space occupied when the player's turn is over, and proceeds from that point on the player's next turn, assuming that nothing happens during another player's turn to cause a switch of places. Two or more playing pieces may rest on the same space at the same time.

A player who rolls a one on his first turn of a race will land on the space marked "Your Horse Is Scratched." This space automatically removes a player from that particular race. It does not, however, necessarily end the game for that player. For instance, if a player lands on this space during the first race, he/she is still eligible to play in races 2–10, unless he/she lands on the space during another race, and is removed from that race.

The photo finish space is only used if two or more players land on it during one complete turn, where one complete turn begins with the first player and goes through all the remaining players. When a player lands on this space, he/she must wait until all of the other players have taken their turns. If no one else lands on the photo finish space, then that player proceeds to the winner's circle, assuming that no other player drew a playing card that altered the final finish or has already reached the winner's circle.

If other players are able to land on the photo finish space before the first player can take his next turn, there is a roll off between the players on the photo finish space. The player with the highest roll picks a Photo Finish Card 70 from the photo finish deck and uses the card's information regarding his horse's abilities, which are stated on the player's racing horse card 80.

There is a particular circumstance in which the player who was initially on the photo finish space can lose a turn. This circumstance applies only if three or more players are playing.

If three players are playing and they are all near the photo finish space, the following can occur: The first player rolls and does not reach the photo finish space. The second player rolls and does reach the photo finish space. The third player rolls and does not reach the photo finish space. The play then goes back to the first player. This time, the first player rolls and does manage to reach the photo finish space. There are now two players in the photo finish space, but a roll off does not occur because a complete turn has not occurred. Therefore, the turn passes to the third player who then rolls in an attempt to reach the photo finish space. If the third player fails to reach the photo finish space, the turn goes to the first player. At this point, there is a roll off between the first and second players.

If the third player does reach the photo finish space, there would simply be a roll off between the three players. The significance of this circumstance is to allow a complete turn to take place, where a complete turn starts with player number one and goes through all the remaining players.

In the event that two or more players are tied at the end of the tenth race, the tied players play a featured 11th match race. This race is run on the dirt track 3. The first player to make it to the winner's circle adds 5 points to his/her score. The second player to reach the winner's circle adds 3 points, and the third player adds 1 point. The Photo Finish Cards are not used during a featured match race, and the photo finish space has no effect on the players' moves.

If a player lands on a "Take a Weather Card" space, he/she must pick a card 40 from the top of the Weather Card deck. The player then uses the card's information to either roll again, lose a turn, or do nothing if the card does not apply. The player determines what is to be done based on the horse's abilities in certain weather conditions, as stated on the Racing Horse Card 80.

If a player lands on a "Pick a Longshot" space, he/she must pick a card 50 from the top of the Longshot Card deck. The player then uses the card's information with regard to his/her horse's racing abilities which are stated on the player's Racing Horse Card 80. Based on that information, he/she may roll again, lose a turn, or do nothing if the card does not apply.

If a player lands on an "Inquiry" space, he/she must pick a card 60 from the top of the Inquiry Card deck. Inquiry cards are not used in connection with the player's horse's abilities. Instead, the player is instantly penalized by loss of a turn or being placed one place below his/her final placing, or rewarded by rolling again or being placed one place above his/her final placing.

Game play is randomized by the interrelationship of the weather, photo finish and longshot with the player's horse card. During game play, a player rolls the die, and then moves his playing piece forward the appropriate number of spaces. When the player lands on a weather, photo finish or longshot card, he then picks the top card from the appropriate deck.

The instruction on the back of the card is then read by the player. For example, the player might pick the following weather card: "Poor track conditions, summer showers. If your horse runs well on wet turf or muddy track, roll again. If not, lose a turn." The player, after reading the instruction, must go back to his horse card to determine whether his horse runs well on wet turf or muddy track because that is an ability in issue on the selected card which must be determined to complete the instruction. If, from the horse card, a player determines that his horse only runs well on grass, for example, he will lose a turn.

However, if that card is picked by a player who has a horse that runs well on wet turf, that player will roll again. The outcomes of the cards are contingent on the horse's abilities of the player who selected the card. The player then moves his playing piece according to the particular outcome generated with the information from the abilities of his horse (from the horse card) and the instruction on the weather, photo finish or longshot card.

The "Almost Home" space has no effect on a player's turn; it is a free space.

If a player lands on the "Nice Late Speed, Move to Photo Finish" space, that player's playing piece is immediately moved to the photo finish space. The rules with regard to photo finishes then apply.

With regard to information on the racing horse cards relative to playing cards, the following rules apply:

"chased fast horse" is not the same as "strong between horses";

"initial start of the year" is the same as "never having won a race";

"will close well" is not the same as "fast in the stretch"; and

"poor speed on any track" is the same as "having not much speed."

The object of the game, provided by the present invention, is for a participating player to finish first, second, or third in as many of ten races as possible, and have the most points at the end of the tenth race.

Whereas a preferred embodiment of the invention has been illustrated and describe in detail, it will be apparent that various changes may be made in the disclosed embodiment without departing from the scope or spirit of the invention.

What is claimed is:

1. A horse racing game board apparatus for simulating races between a plurality of horses, comprising:

a board with two independent tracks, each track having a plurality of spaces thereon;

one six-sided die;

a plurality of playing pieces representing horses;

a plurality of weather cards for determining a change in performance of said horses caused by weather, said plurality of weather cards having designation means, a number of said spaces having designation means for selecting said weather cards to generate weather card outcomes;

a plurality of photo finish cards for determination of a photo finish, said plurality of photo finish cards having designation means to generate photo finish card outcomes, two of said spaces having designation means for selecting said photo finish cards, a first of said two spaces being on a first track of said independent tracks while a second of said two spaces being on a second track of said independent tracks;

a plurality of longshot cards for determining whether one of said horses may win as a longshot, said plurality of long shot cards having designation means, a number of said spaces having designation means for selecting said longshot cards to generate longshot card outcomes;

a plurality of inquiry cards for determining whether there is a sudden change in said race, said plurality of inquiry cards having designation means, a number of said spaces having designation means for selecting said inquiry cards;

a plurality of horse cards for determining abilities of said horses, said plurality of horse cards affecting and randomizing said outcomes of said weather, photo finish, and longshot cards;

a plurality of score cards for tallying results of said races between said plurality of horses;

a plurality of racing cards having designation means for specifying the possible races of the day, potential prize money and whether the race will be run on dirt or turf, parameters for said races of the day being dictated by said designation means for specifying; and each of said weather, photo finish and longshot cards requiring information regarding said abilities of horses found on said horse cards in order to complete the execution of its instruction to generate said outcomes of the weather, photo finish and longshot cards.

2. The horse facing game board apparatus of claim 1, wherein said two independent tracks respectively simulate a dirt track and a turf track.

3. The horse racing game board apparatus of claim 1, wherein said die is used for determining the order of play and amount of movement for each playing piece.

4. The horse racing game board apparatus of claim 1, wherein said playing pieces are in the shape of horses and are of substantially the same color, said playing pieces each having a different color saddle than one another.

5. The horse racing game board apparatus of claim 1, wherein said horse cards carry indicia of data regarding a horses' speed, training, and other racing performance factors.

6. The horse racing game board apparatus of claim 1, wherein said weather cards carry indicia of weather and track condition information for each race.

7. The horse racing game board apparatus of claim 1, wherein each of said photo finish cards include means for determining the order of finish of horses depending on factors contained on the horse cards.

8. The horse racing game board apparatus of claim 1, wherein said longshot cards include increased racing performance data for certain horse cards.

9. The horse racing game board apparatus of claim 1, wherein said inquiry cards include horse racing event data having an influence on the outcome of a race.

10. The horse racing game board apparatus of claim 1, wherein said score cards have spaces for tallying win, place and show points.

11. The horse racing game board apparatus of claim 1, wherein said racing cards carry indicia of data regarding the number of races, the track on which each race is to be run, and points for winning, placing, and showing in each race.

12. The horse racing game board apparatus of claim 1, wherein the independent tracks are divided into a plurality of spaces, each space having an artistic representation of a game instruction illustrated thereon.

13. The horse racing game board apparatus of claim 12, wherein each of said tracks has a space designated as a starting post position, a scratch position, an almost home position, a winner's circle, a slow start position, a fast break from the gate position, and a finish line; each of said tracks has a plurality of said spaces designated as speed increasing positions, a plurality spaces designated as speed inhibiting positions, and a plurality of spaces designated as card selection positions.

14. The horse racing game board apparatus of claim 13, wherein the speed increasing positions include provisions for rolling the die again, for switching position with the lead playing piece, and for moving up to the playing piece next in front.

15. The horse racing game board apparatus of claim 13, wherein the speed inhibiting positions include provisions for losing a turn, and for going back a plurality of spaces.

16. The horse racing game board apparatus of claim 13, wherein the card selection positions include provisions for selecting said inquiry cards, said longshot cards, said weather cards, and said photo finish cards.

17. The horse racing game board apparatus of claim 1, wherein said independent tracks are divided into a plurality of single event, double event, and triple event spaces.

18. The horse racing game board apparatus of claim 17, wherein the single event spaces requires only that a playing piece land on that space only, requiring no further action thereafter.

19. The horse racing game board apparatus of claim 17, wherein the double event spaces require a player to land on that space and to further draw a card or roll the die in order to determine what additional action is required.

20. The horse racing game board apparatus of claim 17, wherein the triple event spaces require a player to land on that space, to further draw a card, and then roll the die in order to determine what additional action is required.

21. A horse racing game board apparatus for simulating races between horses, comprising:

a board with two independent tracks simulating a dirt track and a turf track, respectively, each track having a plurality of spaces thereon;

a plurality of playing pieces representing horses in a running position;

a plurality of weather cards having weather and track conditions for each race thereon, said plurality of weather cards having designation means, a number of said spaces having designation means for selecting said weather cards;

a plurality of photo finish cards having means for determining the order of finish of horses depending on factors contained on the horse cards thereon, said plurality of photo finish cards having designation means, a number of said spaces, one for said dirt track and one for said turf track, having designation means for selecting said photo finish cards;

a plurality of longshot cards having increased racing performance data for certain horse cards thereon, said plurality of longshot cards having designation means, a number of said spaces having designation means for selecting said longshot cards;

a plurality of inquiry cards having horse racing event data which has an influence on the outcome of a race thereon, said plurality of inquiry cards having designation means, a number of said spaces having designation means for selecting said inquiry cards;

a plurality of horse cards having data regarding the horses' speed, training, and other racing performance factors thereon, said plurality of horse cards being used in conjunction with said weather, photo finish, and longshot cards to generate randomized outcomes of said weather, photo finish, and longshot cards so that movement of said playing pieces is affected;

a plurality of score cards having areas for tallying win, place and show points therein to reflect results of said races between said horses;

a plurality of racing cards having designation means for determining the number of races, the track on which each race is to be run, and the points for winning, placing, and showing in each race;

a die for determining the order of play and amount of movement for each playing piece; and each of said weather, photo finish and longshot cards requiring use of said data on said horse cards regarding said performance factors of horses to complete the execution of its instruction and to generate said outcomes of the weather, photo finish and longshot cards.

22. The horse racing game board apparatus of claim 21, wherein the independent tracks are divided into a plurality of spaces, each space including an artistic representation dealing with horse racing illustrated thereon.

23. The horse racing game board apparatus of claim 22, wherein the plurality of spaces for each track include one starting post position, one scratch position, one almost home position, one winner's circle, one slow start position, one fast break from the gate position, finish line, a plurality of speed increasing positions, a plurality of speed inhibiting positions, and a plurality of card selection positions.

24. The horse racing game board apparatus of claim 23, wherein the speed increasing positions include positions for rolling the die again, for switching position with the lead playing piece, and for moving up to the playing piece next in front.

25. The horse racing game board apparatus of claim 23, wherein the speed inhibiting positions include positions for losing a turn, and for going back a plurality of spaces.

26. The horse racing game board apparatus of claim 23, wherein the card selection positions include positions for selecting said inquiry cards, said longshot cards, said weather cards, and said photo finish cards.

27. The horse racing game board apparatus of claim 21, wherein said playing pieces represent horses of substantially the same color; each of said horses having different color saddles from one another.

* * * * *